US007407139B1

(12) United States Patent
Dolan

(10) Patent No.: US 7,407,139 B1
(45) Date of Patent: Aug. 5, 2008

(54) RESILIENT TRASH BAG SUPPORT APPARATUS

(76) Inventor: David L. Dolan, 760 NW. 4th Ct., Boca Raton, FL (US) 33432

( * ) Notice: Subject to any disclaimer, the term of this patent is extended or adjusted under 35 U.S.C. 154(b) by 227 days.

(21) Appl. No.: 10/953,794

(22) Filed: Sep. 29, 2004

(51) Int. Cl.
*B65B 67/04* (2006.01)

(52) U.S. Cl. ..... 248/99; 248/907; 141/391; 220/495.01

(58) Field of Classification Search ..... 248/95, 248/99, 94, 907; 220/495.01, 495.06, 495.08; 141/314, 316, 337, 391
See application file for complete search history.

(56) References Cited

U.S. PATENT DOCUMENTS 4,359,076 A * 11/1982 Kyte ..... 141/391
4,628,007 A * 12/1986 Ledsham ..... 428/542.8
4,783,031 A 11/1988 Ebentheuer
5,129,609 A 7/1992 Tobin
D361,185 S 8/1995 Seiler et al.
5,716,033 A 2/1998 Gibson
5,897,084 A 4/1999 Judge
6,007,030 A * 12/1999 Judge ..... 248/95
6,135,518 A * 10/2000 Holthaus ..... 294/1.1
6,189,841 B1 * 2/2001 LaPoint et al. ..... 248/99
2004/0026578 A1 * 2/2004 King et al. ..... 248/95
2006/0011785 A1 * 1/2006 McLean ..... 248/95

* cited by examiner

*Primary Examiner*—A. Joseph Wujciak, III

(57) ABSTRACT

A trash bag support apparatus includes a flexible and unitary body being selectively adaptable between linear and arcuate positions for removably inserting into a trash bag and engaging with an inner surface thereof. The body has opposed end portions and a top portion integral therewith. A plurality of elongated leg portions having lower edge portions are integrally disposed with the top portion and extend downwardly therefrom for defining a plurality of channels therebetween. The edge portions define a uniform line of weakness below which the trash bag is unsupported by the apparatus.

15 Claims, 3 Drawing Sheets

RESILIENT TRASH BAG SUPPORT APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a support apparatus and, more particularly, to a resilient trash bag support apparatus.

2. Prior Art

Flexible bags are used to hold a great variety of items, many of which have the potential of piercing the bag in which they are placed if the bag is not filled carefully. Thus, it is frequently desirable to support a flexible bag which is in the process of being filled so that the individual filling the bag may use both hands.

One example of a flexible bag which would benefit from a support is the lawn trash bag. These bags are typically made of plastic, and may have a capacity of approximately thirty to sixty gallons. Lawn trash bags are generally filled with leaves, sticks, dead plants, and other trash associated with gardening. One problem associated with their use is the difficulty of filling them. If only one worker is available, he must generally attempt to hold the lawn trash bag open with one hand, while inserting the intended contents with the other. This can be an awkward and time-consuming process. Even if an additional worker is available to hold open the lawn trash bag mouth, the width of the resultant opening is only as wide as the worker's spread fingers-approximately four inches. This opening width may be insufficient to insert much of the trash intended for the bag, such as branches, dead plants, rake-fulls of dead leaves, etc. Another problem associated with manually filling lawn trash bags is that sticks and branches frequently puncture the bag and stick out its sides, thus creating a safety hazard for workers handling the bags.

One solution to these problems has been to provide trash cans to hold bags being filled. This solution works where a permanent trash can installation can be justified, such as the kitchen garbage can. However in many situations, including gardening, there may not be a convenient place to leave a garbage can because the lawn trash is located in a number of places and spread out over a yard or garden. In these settings, it is more convenient to use a support which is lighter and more easily transported than a garbage can.

Accordingly, a need remains for a resilient trash bag support apparatus in order to overcome the above-noted shortcomings. The present invention satisfies such a need by providing an apparatus that is easy to use, lightweight in design, portable, and easy to store. Such an apparatus advantageously reduces the amount of time spent cleaning up after working in the yard, while improving the appearance of the yard. The apparatus conveniently allows a user the use of both hands, which in turn allows for more effective manipulation of the material being discarded. Homeowners, as well as professional landscapers, will appreciate the support apparatus.

BRIEF SUMMARY OF THE INVENTION

In view of the foregoing background, it is therefore an object of the present invention to provide an apparatus for supporting plastic trash bags without assistance. These and other objects, features, and advantages of the invention are provided by an apparatus for assisting a user to maintain a trash bag at a selected position.

The apparatus includes a flexible and unitary body formed from resilient material that is selectively adaptable between linear and arcuate positions. The resilient material is preferably a non-corrosive material such as plastic, for example. Of course, other non-corrosive materials such as aluminum could also be used. Such a body is sized and shaped for removably inserting into a trash bag and engaging with an inner surface thereof for advantageously creating a generally annular top opening so that a user can readily fill the trash bag with debris without handling the trash bag. The body has a centrally disposed latitudinal axis and opposed end portions equally spaced therefrom, including a top portion integral with the end portions that extends along a longitudinal length of the apparatus. The end portions preferably extend laterally and outwardly from the leg portions (described herein below) wherein the leg portions extend downwardly along the inner surface of the trash bag and define a path through which a user may deposit debris into the trash bag.

The top portion is preferably further provided with a plurality of slots equally spaced apart from the axis and extending substantially orthogonal thereto. Such slots define a plurality of handles adjacent to the end portions so that a user can advantageously readily transport a filled trash bag while maintaining a sufficient grip of the apparatus.

The body further includes a plurality of elongated leg portions integrally disposed with the top portion and extending downwardly therefrom along a vertical plane substantially parallel to the axis. Such leg portions are provided with lower edge portions terminating at a selected distance below the top portion for advantageously assisting a user to maintain the trash bag at an open position. The edge portions extend substantially parallel to the axis for defining a uniform line of weakness below which the trash bag is unsupported by the apparatus. The leg portions further define a plurality of channels therebetween wherein the channels extend upwardly along the vertical plane and terminate subjacent the top portion respectively. The leg portions and the channels may have substantially rectangular shapes and are juxtaposed medially of the end portions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
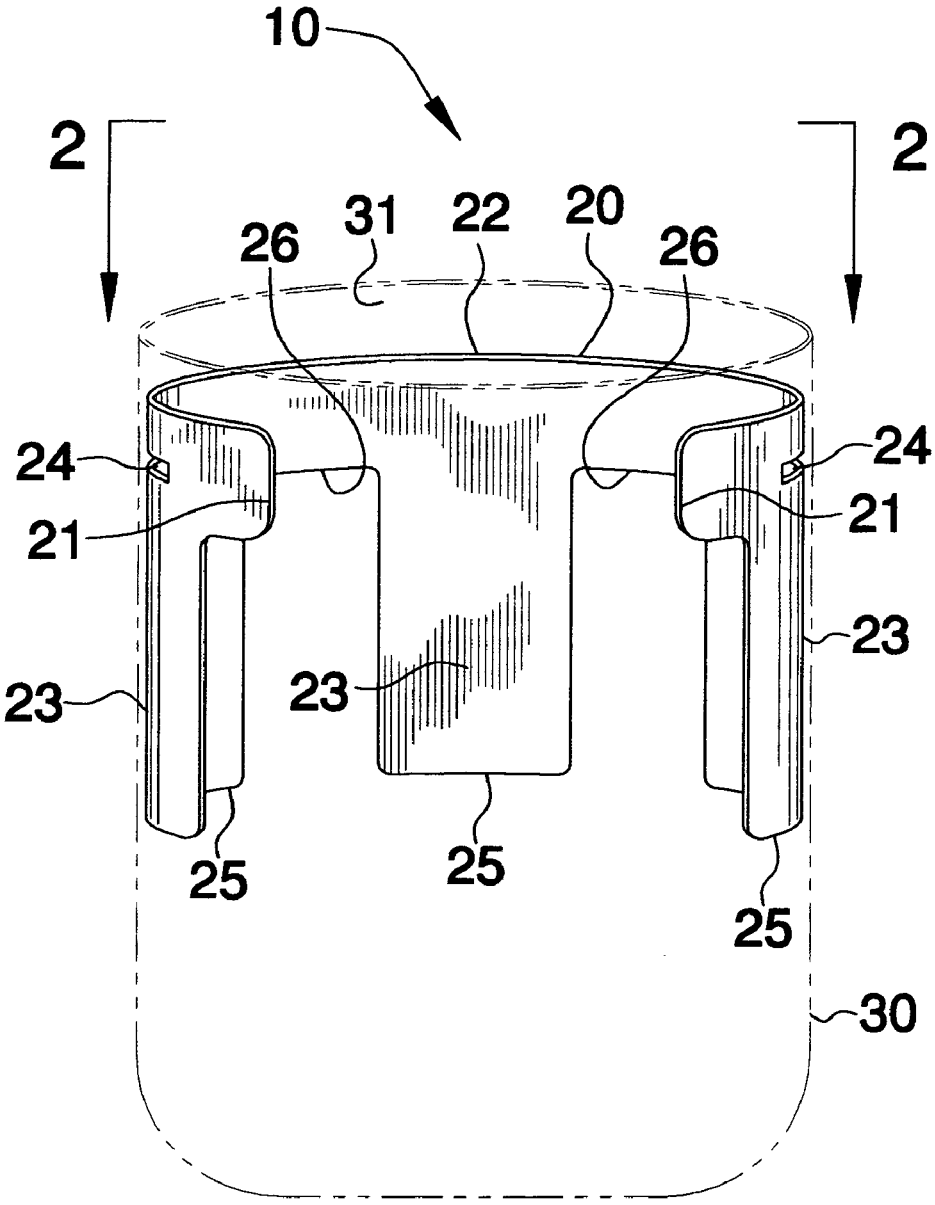
FIG. 1 is a perspective view showing a resilient trash bag support apparatus, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide an apparatus for assisting a user to maintain a trash bag at a selected position. It should be understood that the apparatus 10 may be used to support many different types of bags and should not be limited to only trash bags.

Referring initially to FIG. 1, the apparatus 10 includes a flexible and unitary body 20 formed from resilient material that is selectively adaptable between linear and arcuate positions. The resilient material is a non-corrosive material such as plastic, for example. Of course, other non-corrosive materials such as aluminum could also be used. Such a body 20 is sized and shaped for removably inserting into a trash bag 30 and engaging with an inner surface 31 thereof for advantageously creating a generally annular top opening 32 so that a user can readily fill the trash bag 30 with debris (not shown) without handling the trash bag 30. This feature also advantageously eliminates the need for two individuals to fill a trash bag wherein one individual holds the trash bag 30 open while the other individual fills the trash bag 30 with debris. Thus, the apparatus conveniently decreases the amount of time and the number of laborers needed to perform this simple task. The body 20 has a centrally disposed latitudinal axis and opposed end portions 21 equally spaced therefrom, including a top portion 22 integral with the end portions 21 that extends along a longitudinal length of the apparatus 10. The end portions 21 extend laterally and outwardly from the leg portions 23 (described herein below) wherein the leg portions 23 extend downwardly along the inner surface 31 of the trash bag 30 and define a path through which a user may deposit debris into the trash bag 30.

Figure 2:
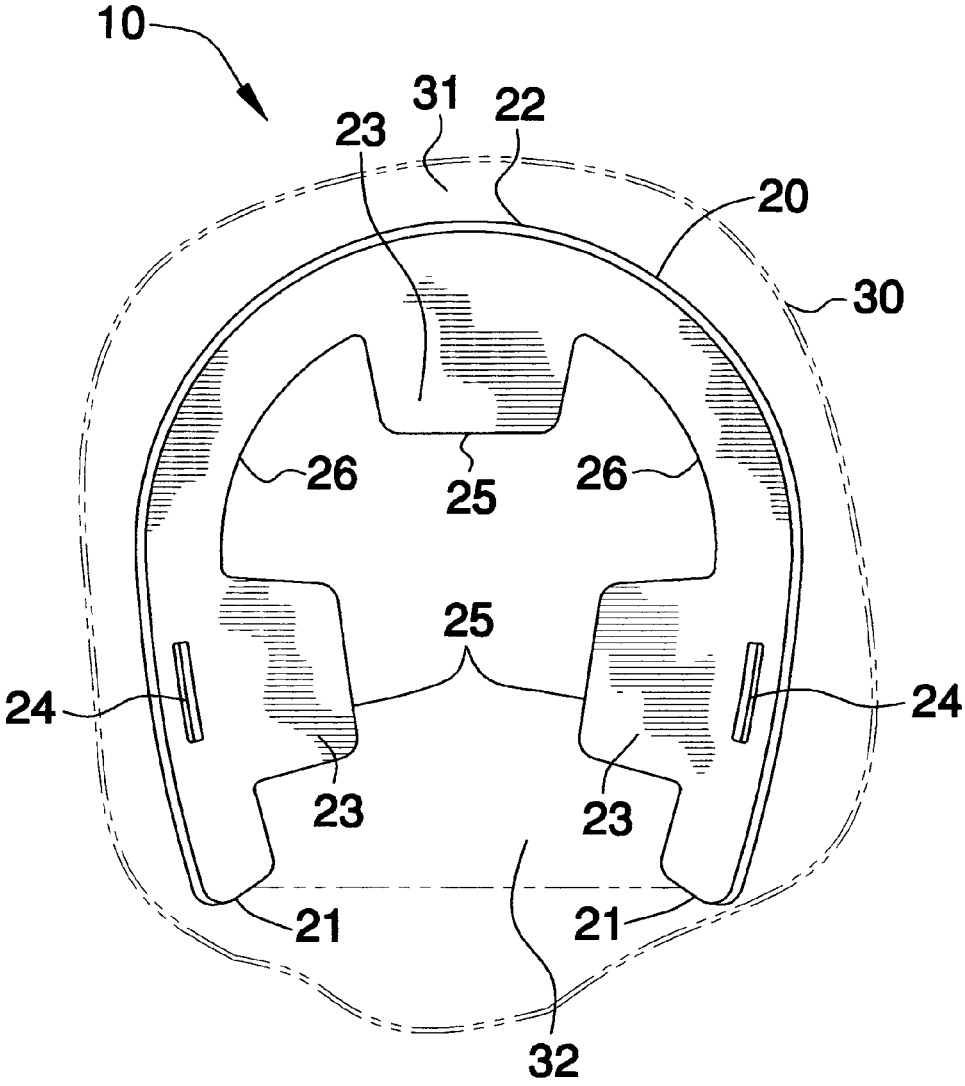
FIG. 2 is a top plan view of the apparatus shown in FIG. 1.
Figure 4:
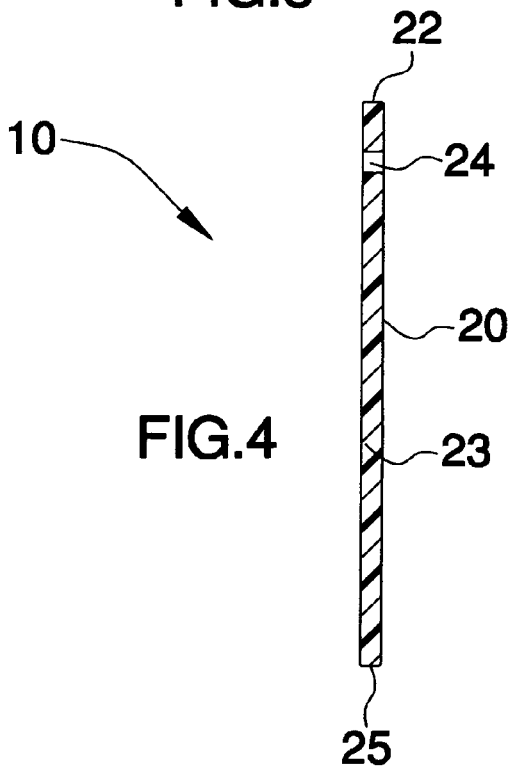
FIG. 4 is an enlarged cross-sectional view of the apparatus shown in FIG. 3, taken along line 4-4.

Referring to FIGS. 2 and 4, the top portion 22 is further provided with a plurality of slots 24 equally spaced apart from the axis and extending substantially orthogonal thereto. Such slots define a plurality of handles 24 adjacent to the end portions 21 so that a user can advantageously readily transport a filled trash bag 30 while maintaining a sufficient grip of the apparatus 10. As is well known, the feat of carrying a filled trash bag 30 usually results in the tearing thereof, but the integrated slots/handles 24 conveniently eliminate this occurrence.

Figure 3:
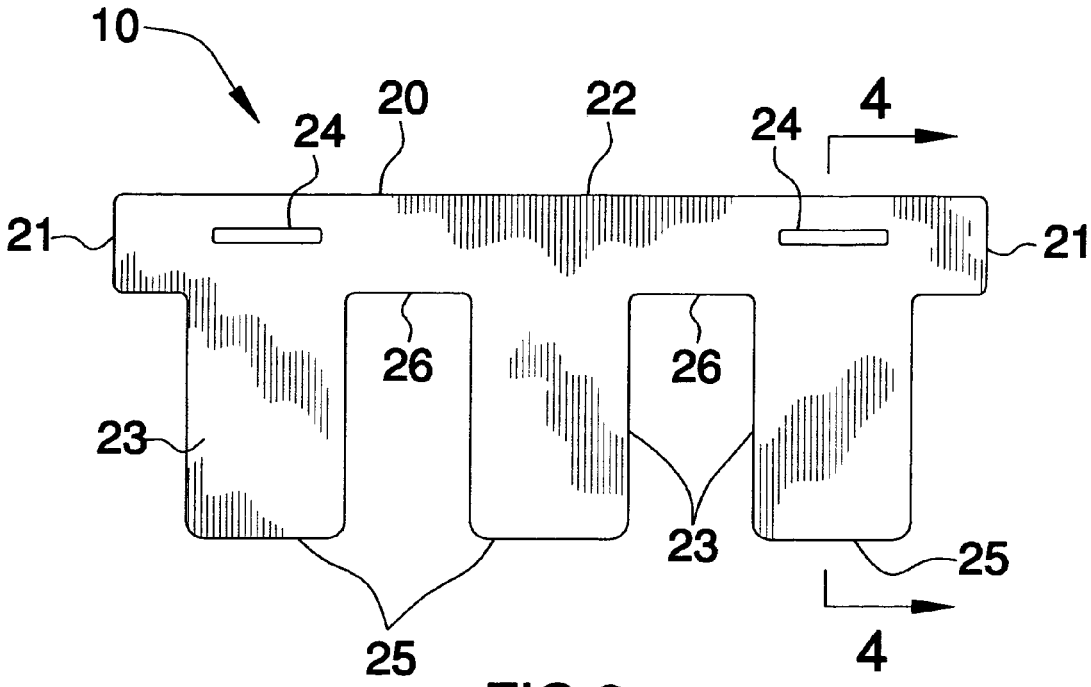
FIG. 3 is a side elevational view of the apparatus shown in FIG. 1.

Referring to FIG. 3, the body 20 further includes a plurality of elongated leg portions 23 integrally disposed with the top portion 22 and extending downwardly therefrom along a vertical plane substantially parallel to the axis. Such leg portions 23 are provided with lower edge portions 25 terminating at a selected distance below the top portion 22 for advantageously assisting a user to maintain the trash bag 30 at an open position. The edge portions 25 extend substantially parallel to the axis for defining a uniform line of weakness below which the trash bag 30 is unsupported by the apparatus 10. The leg portions 23 further define a plurality of channels 26 therebetween wherein the channels 26 extend upwardly along the vertical plane and terminate subjacent the top portion 22 respectively. The leg portions 23 and the channels 26 have substantially rectangular shapes and are juxtaposed medially of the end portions 21. The leg portions 23 and channels 26 advantageously allow for greater flexibility of the top portion 22, conveniently allowing the apparatus 10 to be adjusted to a variety of alternately sized trash bags 30.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for assisting a user to maintain a trash bag at a selected position, said apparatus comprising:

a flexible and unitary body adaptable between linear and arcuate positions, said body being sized and shaped for being removably insertable into a trash bag and engageable with an inner surface thereof for creating a generally annular top opening so that a user can readily fill the trash bag with debris without the necessity of handling the trash bag, said body having a centrally disposed latitudinal axis and opposed end portions equally spaced therefrom, said body including a top portion integral with said end portions and extending along a longitudinal length of said apparatus, said body further including a plurality of elongated leg portions integrally disposed with said top portion and extending downwardly therefrom along a vertical plane substantially parallel to the axis, said leg portions being provided with lower edge portions terminating below said top portion and for assisting a user to maintain the trash bag at an open position, said leg portions defining a plurality of channels therebetween wherein said channels extend upwardly along the vertical plane and terminate subjacent said top portion respectively; each of said leg portions having a longitudinal length at least twice as long as a distance between said top and end portions, wherein said leg portions comprise first, second and third leg portions, each of said first and third leg portions having an inner edge extending parallel to adjacent edges of said second leg portion, wherein said end portions laterally extend beyond outer edges of said first and third leg portions.

2. The apparatus of claim 1, wherein said top portion is further provided with a plurality of slots equally spaced apart from the axis and extending substantially orthogonal thereto, said slots defining a plurality of handles adjacent said end portions so that a user can readily transport a filled trash bag while maintaining a sufficient grip of said apparatus.

3. The apparatus of claim 1, wherein said body is formed from non-corrosive material comprising plastic.

4. The apparatus of claim 1, wherein said leg portions extend downwardly along the inner surface of the trash bag and define a path through which a user may deposit debris.

5. The apparatus of claim 1, wherein said leg portions and said channels have a substantially rectangular shape and are Juxtaposed medially of said end portions.

6. An apparatus for assisting a user to maintain a trash bag at a selected position, said apparatus comprising:

a flexible and unitary body formed from resilient material for being selectively adaptable between linear and arcuate positions, said body being sized and shaped for being removably insertable into a trash bag and engageable with an inner surface thereof for creating a generally annular top opening so that a user can readily fill the trash bag with debris without the necessity of handling the trash bag, said body having a centrally disposed latitudinal axis and opposed end portions equally spaced therefrom, said body including a top portion integral with said end portions and extending along a longitudinal length of said apparatus, said body further including a plurality of elongated leg portions integrally disposed with said top portion and extending downwardly therefrom along a vertical plane substantially parallel to the axis, said leg portions being provided with lower edge portions terminating below said top portion and for assisting a user to maintain the trash bag at an open position, said leg portions defining a plurality of channels therebetween wherein said channels extend upwardly along the vertical plane and terminate subjacent said top portion respectively; each of said leg portions having a longitudinal length at least twice as long as a distance between said top and end portions, wherein said leg portions comprise first, second and third leg portions, each of said first and third leg portions having an inner edge extending parallel to adjacent edges of said second leg portion, wherein said end portions laterally extend beyond outer edges of said first and third leg portions.

7. The apparatus of claim 6, wherein said top portion is further provided with a plurality of slots equally spaced apart from the axis and extending substantially orthogonal thereto, said slots defining a plurality of handles adjacent said end portions so that a user can readily transport a filled trash bag while maintaining a sufficient grip of said apparatus.

8. The apparatus of claim 6, wherein said body is formed from non-corrosive material comprising plastic.

9. The apparatus of claim 6, said leg portions extend downwardly along the inner surface of the trash bag and define a path through which a user may deposit debris.

10. The apparatus of claim 6, wherein said leg portions and said channels have a substantially rectangular shape and are juxtaposed medially of said end portions.

11. An apparatus for assisting a user to maintain a trash bag at a selected position, said apparatus comprising:

a flexible and unitary body formed from resilient material for being selectively adaptable between linear and arcuate positions, said body being sized and shaped for being removably insertable into a trash bag and engageable with an inner surface thereof for creating a generally annular top opening so that a user can readily fill the trash bag with debris without the necessity of handling the trash bag, said body having a centrally disposed latitudinal axis and opposed end portions equally spaced therefrom, said body including a top portion integral with said end portions and extending along a longitudinal length of said apparatus, said body further including a plurality of elongated leg portions integrally disposed with said top portion and extending downwardly therefrom along a vertical plane substantially parallel to the axis, said leg portions being provided with lower edge portions terminating below said top portion and for assisting a user to maintain the trash bag at an open position, said edge portions extending substantially parallel to the axis for defining a uniform line of weakness below which the trash bag is unsupported by said apparatus, said leg portions defining a plurality of channels therebetween wherein said channels extend upwardly along the vertical plane and terminate subjacent said top portion respectively; each of said leg portions having a longitudinal length at least twice as long as a distance between said top and end portions, wherein said leg portions comprise first, second and third leg portions, each of said first and third leg portions having an inner edge extending parallel to adjacent edges of said second leg portion, wherein said end portions laterally extend beyond outer edges of said first and third leg portions.

12. The apparatus of claim 11, wherein said top portion is further provided with a plurality of slots equally spaced apart from the axis and extending substantially orthogonal thereto, said slots defining a plurality of handles adjacent said end portions so that a user can readily transport a filled trash bag while maintaining a sufficient grip of said apparatus.

13. The apparatus of claim 11, wherein said body is formed from non-corrosive material comprising plastic.

14. The apparatus of claim 11, wherein said leg portions extend downwardly along the inner surface of the trash bag and define a path through which a user may deposit debris.

15. The apparatus of claim 11, wherein said leg portions and said channels have a substantially rectangular shape and are juxtaposed medially of said end portions.

* * * * *